US006571994B1

(12) United States Patent
Adams et al.

(10) Patent No.: US 6,571,994 B1
(45) Date of Patent: Jun. 3, 2003

(54) CLOSURE HAVING ROTATABLE SPOUT AND AXIALLY MOVABLE STEM

(75) Inventors: Brian M. Adams, Newark, CA (US); Mike Xiaoli Ma, San Jose, CA (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

(21) Appl. No.: 10/017,187

(22) Filed: Dec. 12, 2001

(51) Int. Cl.[7] ..... B67D 3/00

(52) U.S. Cl. ..... 222/521; 222/525; 222/81; 222/83.5; 222/83

(58) Field of Search ..... 222/519, 520, 222/521, 525, 546, 541.2, 548, 554, 562, 563, 499, 83, 81, 83.5, 88; 220/277, 278, 254.8, 258.3, 258.4, 259.3; 215/387

(56) References Cited

U.S. PATENT DOCUMENTS

| | | | |
|---|---|---|---|
| 4,690,304 | A | 9/1987 | Morel |
| 5,020,690 | A | 6/1991 | Kishikawa et al. |
| 5,027,979 | A | 7/1991 | Kawajiri et al. |
| 5,228,592 | A | 7/1993 | Pellerano |
| 5,465,876 | A | 11/1995 | Crisci |
| 5,590,798 | A | 1/1997 | O'Connell |
| 5,680,969 | A | 10/1997 | Gross |
| 5,927,565 | A | 7/1999 | Paczonay |
| 5,938,086 | A | 8/1999 | Gross |
| 6,065,651 | A | 5/2000 | Tedeschi, Jr. et al. |
| 6,095,375 | A | 8/2000 | Adams et al. |
| 6,095,382 | A | 8/2000 | Gross |
| 6,112,923 | A | 9/2000 | Ma |
| 6,161,728 | A | 12/2000 | Dark |
| 6,173,853 | B1 | 1/2001 | Luch |
| 6,230,884 | B1 | 5/2001 | Coory |
| 6,244,476 | B1 | 6/2001 | Moretti |

FOREIGN PATENT DOCUMENTS

| | | | |
|---|---|---|---|
| EP | 1010634 | A1 | 6/2000 |
| EP | 1147994 | A1 | 10/2001 |
| WO | WO 00/23344 | A1 | 4/2000 |
| WO | WO 00/27717 | A1 | 5/2000 |
| WO | WO 01/08996 | A1 | 2/2001 |
| WO | WO 01/36289 | A1 | 5/2001 |
| WO | WO 02/074647 | A1 | 9/2002 |

*Primary Examiner*—Ehud Gartenberg
*Assistant Examiner*—Frederick Nicolas
(74) *Attorney, Agent, or Firm*—Dorsey & Whitney LLP

(57) ABSTRACT

A closure for a container having a foil or membrane sealed opening. The closure includes a cap, a spout and a stem. The stem includes a downwardly extending piercing structure adapted for piercing the foil or membrane of the container upon rotation of the spout relative to the cap. The cap includes a cap top, a cap skirt depending from the cap top, an open sleeve and a stem guide. The open sleeve has an inwardly extending thread adapted to detachably engage the container. The open sleeve extends upwardly from the cap top. The stem guide extends along an internal surface of the sleeve. The spout rotatably engages the sleeve and includes a spout top having a central aperture, an outer spout skirt and an inner skirt. The outer skirt depends from the spout top radially outward of the sleeve and rotatably engages the sleeve. The inner spout skirt depends from the spout top radially within the sleeve. The stem includes a substantially cylindrical body positioned radially within the inner spout skirt, a plug for selectively sealing the central aperture, an outwardly extending spout-engaging thread, and an outwardly extending cap-engaging member. The spout engaging member engages the inner spout skirt and is adapted for helical motion with respect to the inner spout skirt. The cap-engaging member engages the stem guide and is adapted for axial motion with respect to the sleeve. Preferably, the stem guide includes a substantially vertically extending groove and the cap-engaging member includes a tab received in the groove.

21 Claims, 6 Drawing Sheets

CLOSURE HAVING ROTATABLE SPOUT AND AXIALLY MOVABLE STEM

TECHNICAL FIELD

This invention relates to a new and improved closure for a container. More particularly, the present invention is directed to a closure for a container having an opening sealed by a sheet member such as a foil or membrane seal.

BACKGROUND OF THE INVENTION

Bottled beverages have long been a staple in the American household. In recent years, bottled water, sport drinks and other bottled beverages have increased in popularity. In fact, according to The Bottled Water Web™, bottled water sales alone reached $1.4 billion in 1999 and are expected to grow at a compound annual rate of about 15% over the next five years.

Bottled water, sport drinks and other bottled beverages are often packaged in a container having a push-pull resealable closure spout. An exemplar closure having a resealable bottle cap with a push-pull spout is U.S. Pat. No. 5,465,876 to Crisci. These caps are generally characterized by having an orificed spout slidably moveable on a cylindrical tube. The tube has a plug at an open end. Linear motion of the spout relative to the tube alternatively causes the plug to seal or unseal the spout orifice. Effective sealing is achieved through interference of the plug with the internal diameter of the orifice. However, increasing this interference to improve sealing may lead to excessive opening and closing forces, since the linear motion involved limits mechanical advantage.

Often, known containers used in combination with the closures of the type disclosed by the Crisci '876 patent include a foil or membrane seal to preserve freshness and otherwise prevent tampering with the contents of the container. Disadvantageously, a consumer must unscrew or otherwise remove the closure from the container, remove the foil or membrane seal and screw the closure back onto the container. Only then may the consumer access the contents of the container through the push-pull closure.

One known container/closure combination which allows a consumer to cut through a lid without removing the closure from the container is disclosed by U.S. Pat. No. 4,690,304 to Morel. The Morel '304 patent discloses an obturating device for tubes, flasks and other containers, the opening and closing of which are controlled through rotation. Disadvantageously, the device disclosed by the Morel '304 patent has a complex structure and is not designed for conventional containers for bottled beverages.

Yet another known container/closure combination is disclosed by U.S. Pat. No. 5,938,086 to Gross. The Gross '085 patent discloses a container and closure with a non-rising rotatable housing, dispensing valve, and separate releasable internal shipping seal. Similar to the Morel device, the closure disclosed by the Gross '085 patent is controlled through rotation. Disadvantageously, the closure disclosed by the Gross '085 patent also has a complex structure and is not designed for conventional containers for bottled beverages.

What is needed is a closure for a container which overcomes the above and other disadvantages of known closures.

SUMMARY OF THE INVENTION

In summary, one aspect of the present invention is directed to a closure for a container having a foil or membrane sealed opening. The closure includes a cap, a spout and a stem. The cap includes a cap top, a cap skirt depending from the cap top, an open sleeve and a stem guide. The cap skirt has an inwardly extending thread adapted to detachably engage the container. The open sleeve extends upwardly from the cap top. The stem guide extends along an internal surface of the sleeve. The spout rotatably engages the sleeve and includes a spout top having a central aperture, an outer spout skirt and an inner skirt. The outer skirt depends from the spout top radially outward of the sleeve and rotatably engages the sleeve. The inner spout skirt depends from the spout top radially within the sleeve. The stem includes a substantially cylindrical body positioned radially within the inner spout skirt, a plug for selectively sealing the central aperture, an outwardly extending spout-engaging thread, and an outwardly extending cap-engaging member. The spout engaging member engages the inner spout skirt such that the stem is adapted for helical motion with respect to the spout. The cap-engaging member engages the stem guide such that the stem is adapted for axial motion with respect to the cap upon rotation of the spout.

The stem guide of the cap comprises structure to restrict relative rotation between the cap and stem. In one embodiment, the stem guide of the cap includes a substantially vertically extending groove and the cap-engaging member of the stem includes a tab received in the groove.

In one embodiment the stem includes a downwardly extending piercing member adapted for piercing the foil or membrane of the container upon rotation of the spout relative to the cap.

Optionally, the cap includes a tamper-evident band frangibly connected to a bottom portion of the cap skirt that is adapted to detachably engage the container.

Optionally, the cap includes a rotation stop limiting rotation of the spout relative to the cap.

Optionally, the spout and/or stem includes structure to limit relative rotation between the spout and stem.

Optionally, the spout top includes a non-cylindrical outer wall that forms a gripping portion that facilitates gripping and rotation of the spout by a user.

Optionally, one of the cap and spout includes a tamper stop and the other of the cap and spout includes a removable tamper tab engaging the tamper stop, the tamper tab engaging the tamper stop and preventing substantial rotation of the spout relative to the cap until the tamper tab is removed.

An object of the present invention is to provide a container closure having a rotatable spout and an axially movable stem for facilitating opening and closure of bottled substances.

Another object of the present invention is to provide a closure for a resealable container having a foil or membrane sealed opening.

Yet another object of the present invention is to provide a closure for a bottled substance having a foil or membrane sealed opening that is capable of opening the sealed opening without first removing the closure from the container.

Yet another object of the present invention is to permit increased interferences between sealing members by employing the mechanical advantage offered by helical structure in bringing dimensionally interfering surfaces into position.

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
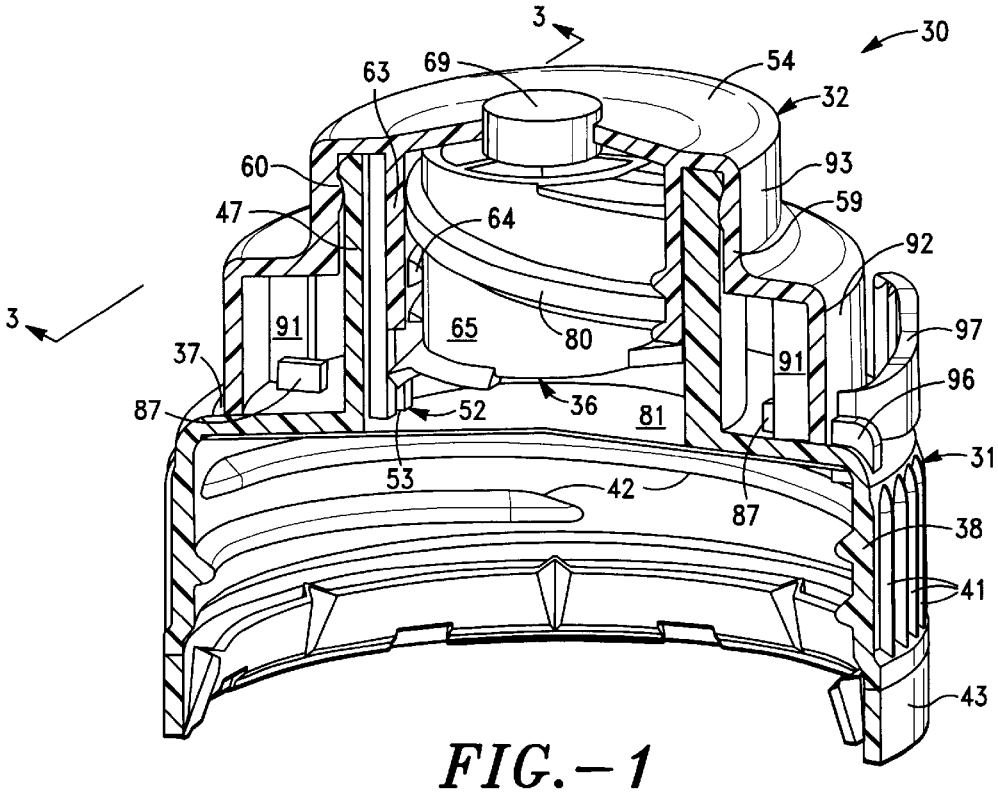
FIG. 1 is a perspective cross-sectional view of a closure for a foil or membrane sealed container in accordance with the present invention showing a cap, a spout, and a stem of the closure with the stem in an initial closed position.

A closure 30 in accordance with the present invention is shown in FIG. 1. The illustrated closure can be used with a container of the type often used for bottled water, sport drinks and other flowable bottled substances. The closure of the present invention is particularly suited for use with containers having an opening that is sealed by a foil or membrane seal The closure of the present invention generally includes a cap 31 adapted for releasably engaging the container, a spout 32 rotatably mounted on cap 31, and a stem 36 axially mounted on cap 31 and positioned within spout 32. Each of cap 31, spout 32 and stem 36 may advantageously be formed as monolithic thermoplastic members using, for example, injection molding techniques well known in the art.

In the illustrated embodiment, cap 31 is generally dimensioned and configured to cooperate with a container having a tamper-evident neck finish of the type shown in U.S. Pat. No. 6,112,923 to Ma, the entire contents of which are incorporated herein by this reference. One should appreciate, however, that cap 31 can be adapted to cooperate with other container neck finishes within the scope of the present invention. For example, a cap in accordance with the present invention can be adapted to cooperate with a container having a snap-on, screw-off cap neck finish of the type shown in U.S. Pat. No. 6,173,853 to Luch, the entire contents of which are incorporated herein by this reference. Alternatively, other cooperative closure-container retention structure, such as a simple snap engagement, can also be employed in accordance with the present invention.

Cap 31 includes a generally annular cap top 37. Although the illustrated cap top 37 is planar, the cap top can alternatively have a frustoconical or other suitable shape. A cap skirt 38 depends downwardly from cap top 37 in a well known manner. Cap skirt 38 includes vertically extending ribs 41 extending from an external surface thereof to provide a gripping surface for facilitating a user in gripping and turning cap 31. Cap skirt 38 also includes a container-engaging member extending from an internal surface of the cap skirt. In the illustrated embodiment, the container-engaging member includes two internal threads 42. As noted above, the cap can be adapted for use with various container neck finishes in which case a different thread or snap fit configuration can be used. Preferably, a tamper-evident band 43 is frangibly connected to a bottom portion of cap skirt 38 and is adapted to detachably engage the container in a well known manner, as described in the '923 patent to Ma.

Figure 3:
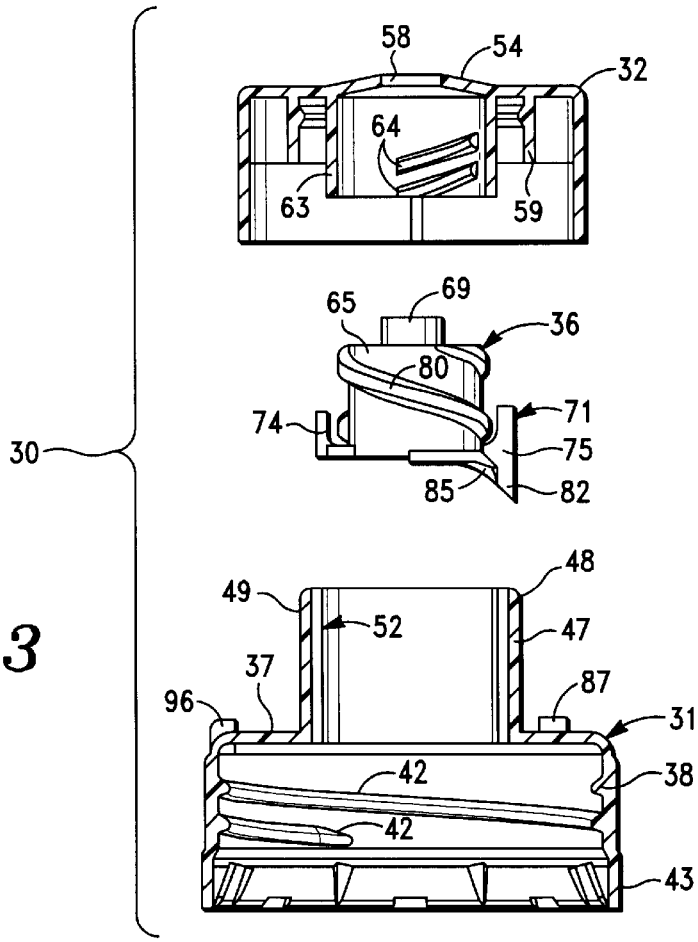
FIG. 3 is an exploded view of the closure of FIG. 1 with the a cross-sectional view of the cap and spout taken along line 3—3 of FIG. 1 and a side elevational view of the stem.
Figure 7:
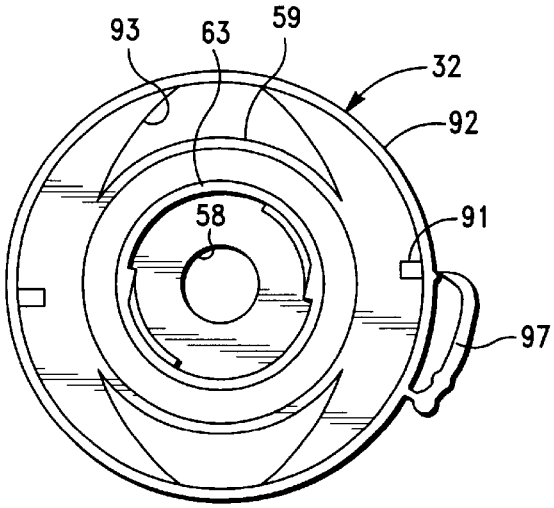
FIG. 7 is a bottom plan view of the spout of FIG. 1.
Figure 6:
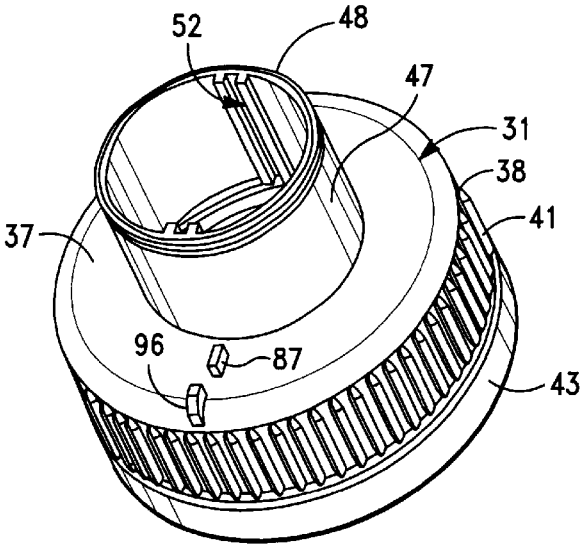
FIG. 6 is a perspective view of the cap of FIG. 1.

A substantially cylindrical open sleeve 47 extends upwardly from a central portion of cap top 37. The illustrated sleeve is concentric with a central axis of cap 31, however, one should appreciate that the sleeve can be offset to one side of the cap. An outwardly extending bead 48 extends outwardly from an upper portion of sleeve 47 and provides a downward facing shoulder 49, as most clearly shown in FIGS. 3 and 6, that is rotatably engageable with spout 32. Although bead 48 is adjacent the upper edge of sleeve 47, the bead can be positioned anywhere along the sleeve provided it has a downward facing shoulder 49 formed to be rotatably engageable with the spout.

Cap sleeve 47 further includes a stem guide 52 for engaging stem 36 and guiding the stem for axial motion within spout 32. Stem guide 52 extends radially inward and along an internal surface of sleeve 47. The illustrated embodiment includes substantially vertically extending stem guide 52 in the form of two diametrically opposed grooves 53. One should appreciate that one, two or more grooves can be used in accordance with the present invention as such grooves need only to prevent relative rotation of the stem relative to the cap, as will become evident below.

Spout 32 is rotatably mounted on sleeve 47 of cap 31. Spout 32 includes a spout top 54 having a central aperture 58 through which the contents of the container can be dispensed. A cylindrical outer spout skirt 59 depends from spout top 54 and is located radially outward of sleeve 47. Outer spout skirt 59 includes an inwardly extending circumferential bead 60 which cooperates with outwardly extending bead 48 of sleeve 47 to limit axial displacement while allowing rotation of spout 32 relative to cap 31. Alternatively, the outer spout skirt can be provided with a bead, and the sleeve with a circumferential groove, or the sleeve with a bead and the spout with a groove, in order to provide a suitable rotatory connection between the spout and the cap. One should appreciate that either one or both of the bead and the groove can be segmented provided the configuration allows for circumferential motion there between. Preferably, the cooperating beads 48 and 60 are diametrically interfering to provide a liquid tight seal between the inner surface of outer spout skirt 59 and sleeve 47. However, if the bottled contents are flowable granular solid, this seal requirement between spout and sleeve can be relaxed and need not be liquid tight.

Spout 32 further includes an inner spout skirt 63 depending from spout top 54. Inner spout skirt 63 is positioned radially within both outer spout skirt 59 and sleeve 47. Internally extending helical guides 64 extend from an inner surface of inner spout skirt 63 which cooperate with stem 36, as discussed below.

Figure 2:
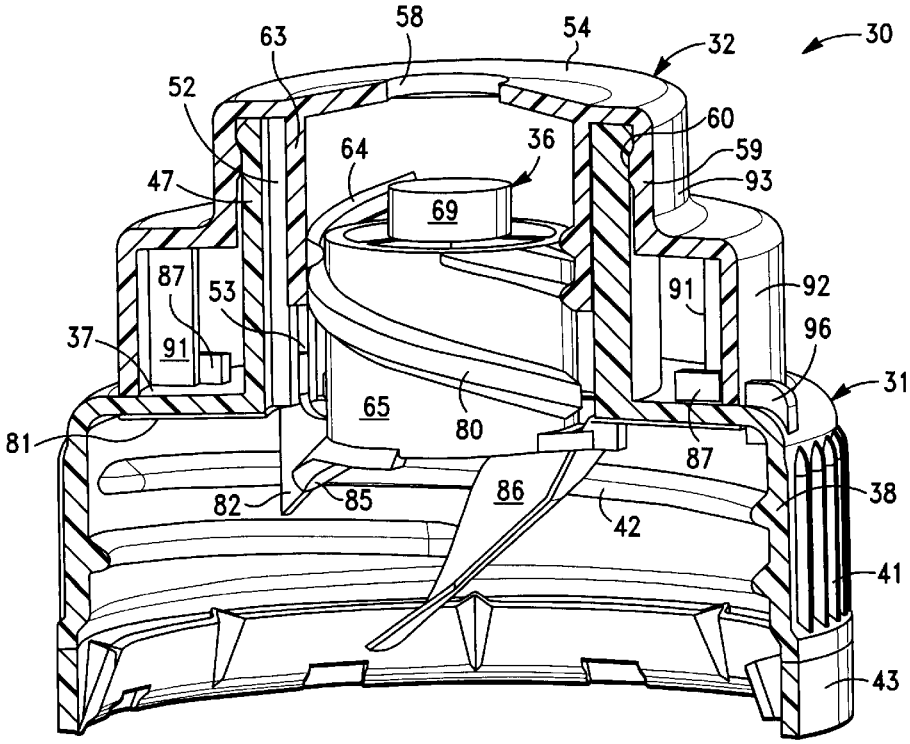
FIG. 2 is perspective cross-sectional view of the closure of FIG. 1 showing the stem of the closure in an opened position.

Stem 36 is positioned radially within sleeve 47 and inner spout skirt 63 and stem 36 is axially slidable from an initial closed position, as shown in FIG. 1, to an open position, as shown in FIG. 2. In the embodiments of FIGS. 1–6, stem 36 includes a substantially cylindrical body 65 and an upwardly projecting plug 69. Although the illustrated plug is cylindrical, one should appreciate that the plug need not be cylindrical provided it has a shape that is complementary to the shape of the central aperture. For example, the plug and the aperture may have a complementary frustoconical, oval, polygonal, or other suitable shape. In the illustrated embodiment, three webs 70 rigidly interconnect cylindrical body 65 and plug 69 in such a manner that allows the contents of the container to pass through stem 36 and to central aperture 58 of spout 32. One should appreciate that one or more webs can be used in accordance with the present invention. One should also appreciate that the stem need not be cylindrical in shape. The only requirements for the stem are that the stem is able to seal orifice 58 in a first stem position and stem allows bottled contents to flow to the orifice in a second open stem position. For example, the stem can be a solid member having one or more passageways therethrough allowing the contents of the container to pass through or around the stem. Alternatively, the stem can be a cross-shaped structure as embodied in FIGS. 10 and 11, as discussed below.

Stem 36 includes an outwardly extending cap-engaging member 71 that engages stem guide 52 and allows axial motion of stem 36 with respect to sleeve 47. In the illustrated embodiment, cap-engaging member 71 is in the form of a pair of outwardly extending anti-rotation tabs 74 and 75. Each tab 74 and 75 is received in a respective one of the diametrically opposed grooves 53 located on an internal surface of sleeve 47. Preferably, tabs 74 and 75 extend upwardly between the inner surface of sleeve 47 and inner spout skirt 63 to provide stem 36 with increased structural integrity and minimize the possibility of tilting the plug out of alignment with the central aperture.

One should appreciate that one, two or more circumferentially spaced tabs can be used in accordance with the present invention provided each tab cooperates with a corresponding groove and prevents relative rotation of stem 36 relative to cap 31. One should also appreciate that other configurations can be used in accordance with the present invention. For example, the stem can include pairs of outwardly extending splines forming a groove which, in turn, cooperates with a corresponding internal spline located on the internal surface of the cap sleeve.

Stem 36 further includes an outwardly extending spout-engaging member which is configured to allow helical motion between stem 36 and spout 32. In particular, an external helical thread 80 extends outwardly from an external surface of cylindrical body 65 and cooperate with the helical guides 64 of inner spout skirt 63. One should appreciate that other types of spout-engaging members can be used within the scope of the present invention. For example, one or more outwardly extending pins or other protrusions can extend from the external surface of the cylindrical body and cooperate with helical grooves formed in the internal surface of the inner spout skirt. Alternatively, inwardly extending pins or other protrusions can extend from the internal surface of the inner spout skirt and cooperate with helical grooves formed in the external surface of the cylindrical body.

As noted above, the closure of the present invention is particularly suited for use with containers having an opening that is initially sealed by a foil or membrane seal. A foil or membrane seal 81 is schematically shown in FIG. 1 and positioned immediately below top 37 of cap 31. Seal 81 is conventionally affixed to seal the opening of a container in a well known manner. In one form of processing, a foil is first inserted into the closure at the closure manufacturing facility and is conveyed with the closure to the bottling line. After application of the closure to the container, the foil is heat sealed to the bottle by well-known methods such as induction heating. In another form of processing, a foil or membrane is first adhered to the mouth of a filled container by well known method such as conductive heating, induction heating or adhesive attachment. The closure is then subsequently applied to the sealed container.

In use, such a foil or membrane seal must be pierced, torn, ruptured or otherwise damaged in order to gain access to the contents of the container. In this regard, stem 36 is provided with a downwardly extending piercing structure 82. Preferably, piercing structure 82 is a downwardly extending portion of one or more of the tabs, for example, tab 75, and includes a wedge portion 85. Stem, piercing structure, tab and wedge are all preferably monolithically formed as a one-piece member, although they also can be formed as a plurality of members which are secured together as a unit.

As stem 36 is axially slid from the initial closed position shown in FIG. 1 to the open position shown in FIG. 2, piercing structure 82 pierces into foil or membrane seal member 81 and cuts a flap 86 in member 81. Wedge portion 85 pushes flap 86 away from the remainder of seal 81, as shown in FIG. 2, thus allowing the contents of the container to dispense through closure 30. As shown in FIG. 2, flap 86 remains attached to member 81 thus minimizing the chance that flap 86 could fall into the contents of the container and/or be dispensed through or clog the central aperture.

In one embodiment of the present invention, closure 30 further includes a rotation stop limiting rotation of spout 32 relative to cap 31. As shown in FIG. 1, a pair of diametrically opposed rotation stops 87 extend upwardly from cap top 37 and cooperate with an pair of internal splines 91 extending inwardly from an internal surface of a lower cylindrical outer wall 92 of spout 32. This configuration limits rotation of spout 32 relative to cap 31 to approximately 180°. One should appreciate that the actual range of rotation between the spout and cap can be varied and the stops can be positioned accordingly. In particular, the stops can be modified to limit rotation to a larger or smaller angle to correspond with the pitch of the threaded connection between the stem and the spout. For example, in the event that the pitch is double that of the illustrated embodiment, the stops can be modified to limit relative rotation between the spout and cap to 90° because such rotation still produces the same amount of axial motion of the stem with respect to the cap.

Figure 8:
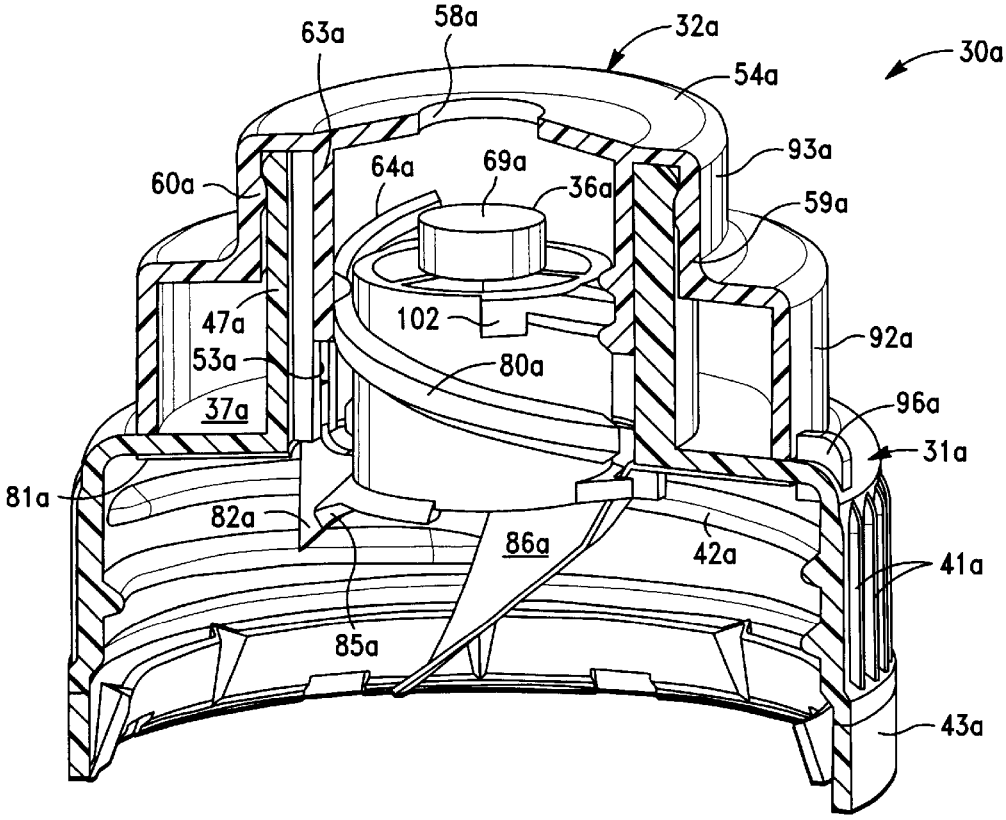
FIG. 8 is a perspective cross-sectional view of a modified closure for a membrane sealed container in accordance with the present invention similar to that shown in FIG. 1 with a modified stem in an opened position.
Figure 9:
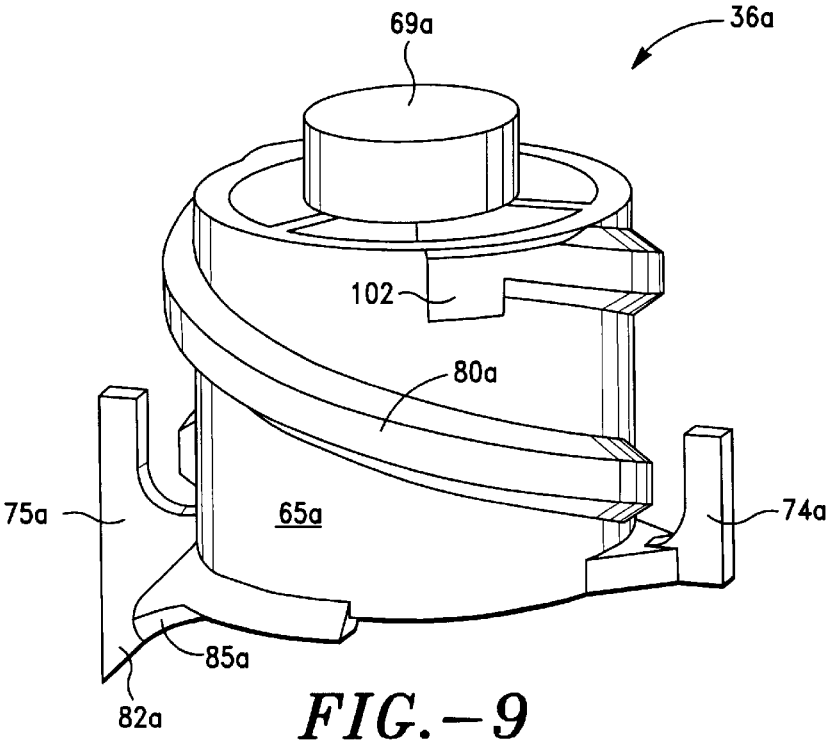
FIG. 9 is an enlarged perspective view of the stem shown in FIG. 8.

Other structure can be utilized to for limiting relative rotation between stem 36 and spout 32 in accordance with the present invention. For example, because relative rotation between stem 36 and sleeve 47 is prohibited, placing a barrier at the top end of helical thread 80 would serve to prevent axial motion of the stem past its full-open position, as shown in FIGS. 8 and 9 and discussed below.

Figure 4:
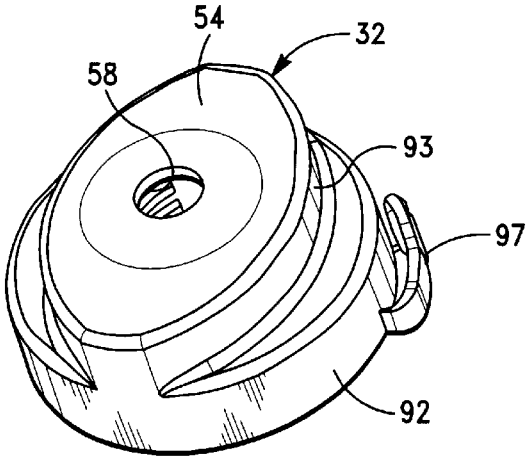
FIG. 4 is a perspective view of the closure spout of FIG. 1.
Figure 5:
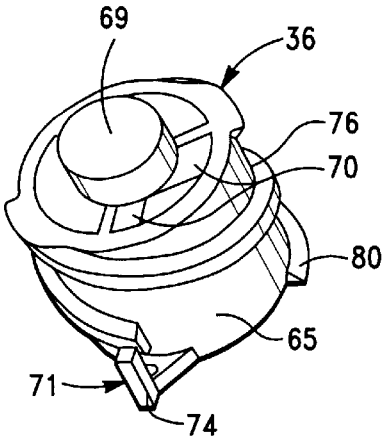
FIG. 5 is a perspective view of the stem of FIG. 1.

In one embodiment of the present invention, spout 32 includes an substantially oval-shaped outer wall 93 of spout skirt 59, as best seen in FIG. 4. Upper outer wall 93 forms a convenient gripping portion on spout 32 which facilitates a user in gripping and rotating spout 32 relative to both cap 31 and the container. One should also appreciate that the spout can be round instead of oval and can include ribs to facilitate a user gripping the spout.

In one embodiment of the present invention, a tamper-evident stop 96 is provided on cap top 37. A removable tamper-evident tab 97 is provided on spout 32. Tamper-evident tap 97 is frangibly connected to an outer surface of the lower outer wall 92 and initially engages tamper stop 96 such that spout 32 cannot be rotated relative to cap 31 until tamper-evident tab 97 is removed. One should appreciate that other suitable tamper-evidencing means can be used to initially limit rotation between the spout and the cap.

In operation and use, once the closure and corresponding foil or membrane sealed container are in the hands of a consumer or user, the user can be assured that closure 31 has not violated seal 81 provided tamper evident tab 97 and tamper-evident band 43 remain undamaged and intact.

In order to dispense the contents of the container, the user grips and pulls tamper-evident tab 97 and tears it away from spout 32. The user then grips spout 32 and rotates it clockwise with respect to cap 31 which, through the helical cooperation of helical guides 64 of spout 32 and helical thread 80 of stem 36, slides stem 36 downwardly from the initial closed position shown in FIG. 1 toward the open position shown in FIG. 2. In the illustrated embodiment, external helical thread 80 of stem 36 is opposite that of closure-engaging thread 42 of cap 31 whereby twisting spout 32 cannot inadvertently loosen cap 31 with respect to the container. As stem 36 slides downwardly, piercing structure 82 of stem 36 contacts and pierces foil or membrane seal 81 and plug 69 moves away from central aperture 58, thus providing passageway through which the contents of the container can pass through closure 30. Continued downward motion of stem 36 causes wedge portion 85 of stem 36 to fold flap 86 away from the remainder of seal 81 to provide a significant unobstructed opening in seal 81 through which the container contents can pass.

Once the user has dispensed some or all of the contents of the container, the user can rotate spout 32 counterclockwise with respect to cap 31 in order to close and fluidly seal closure 30. In particular, as the user rotates spout 32, stem 36 axially slides upwardly from the open position shown in FIG. 2 and returns to the closed position shown in FIG. 1. Plug 69 enters central aperture 58 and fluidly seals the closure and container.

The closure of the present invention advantageously provides a convenient means for a user to open a foil or membrane sealed beverage container with a mere twist of a spout. The closure of the present invention eliminates the need for the consumer to remove the closure from the container in order to puncture, tear and/or remove the foil or membrane seal from the container.

The closure of the present invention advantageously also provides a convenient means to reseal the container with a mere twist of a spout. In this regard, the closure of the present invention permits improved reseal characteristics compared to current "push-pull" closures. This is a result of the ability to increase sealing interferences between the plug 69 and the central aperture 58. This is a direct result of using rotational motion of the spout to accomplish axial movement of the stem. The increased mechanical advantage produced by the rotational motion allows interferences to be increase without opening and closing forces becoming excessive.

FIGS. 8 and 9 show another embodiment in accordance with the present invention having a closure 30*a*. Like reference numerals have been used to describe like components of closures 30 and 30*a*. Stem 36*a* is substantially the same as stem 36 of the previous figures but includes a barrier 102 at the top end of helical thread 80*a* to prevent axial motion of stem 36*a* past its full-open position, as shown in FIG. 8. In this embodiment, barrier 102 limits the range of rotation between spout 32*a* and stem 36*a*. As relative rotation between cap 31*a* and stem 36*a* is limited because anti-rotation tabs 74*a* and 75*a* of stem 36*a* are received within opposed grooves 53*a* of cap 31*a*, the range of rotation between spout 32*a* and cap 31*a* is also limited by barrier 102. Accordingly, rotation stops are not necessary to limit the range rotation between spout 32*a* and cap 31*a* and are not provided in this embodiment.

Figure 10:
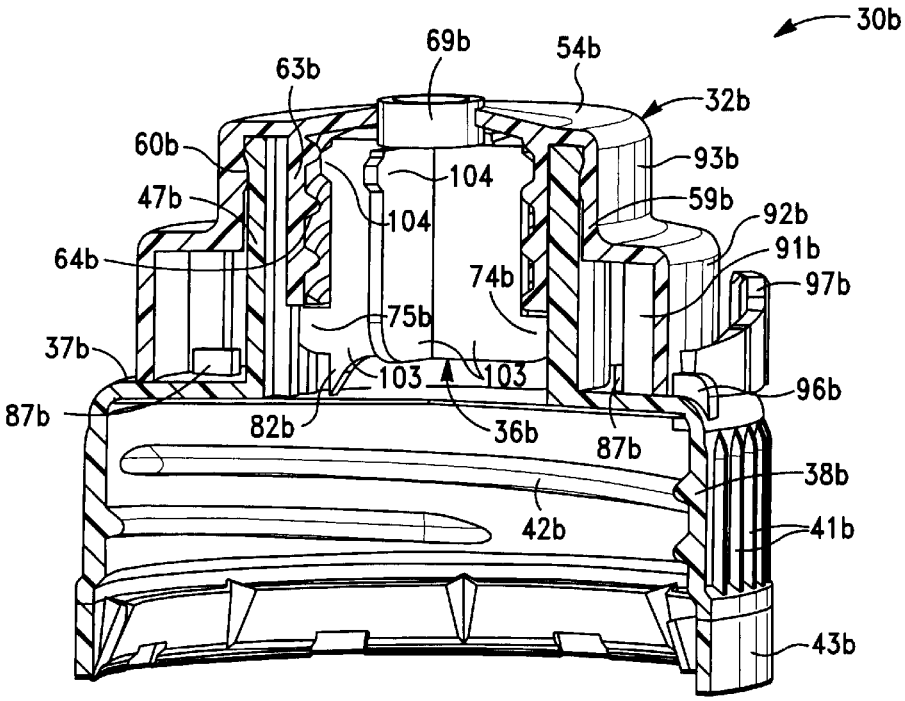
FIG. 10 is a perspective cross-sectional view of a modified closure for a membrane sealed container in accordance with the present invention similar to that shown in FIG. 1 with a modified stem in an initial closed position.
Figure 11:
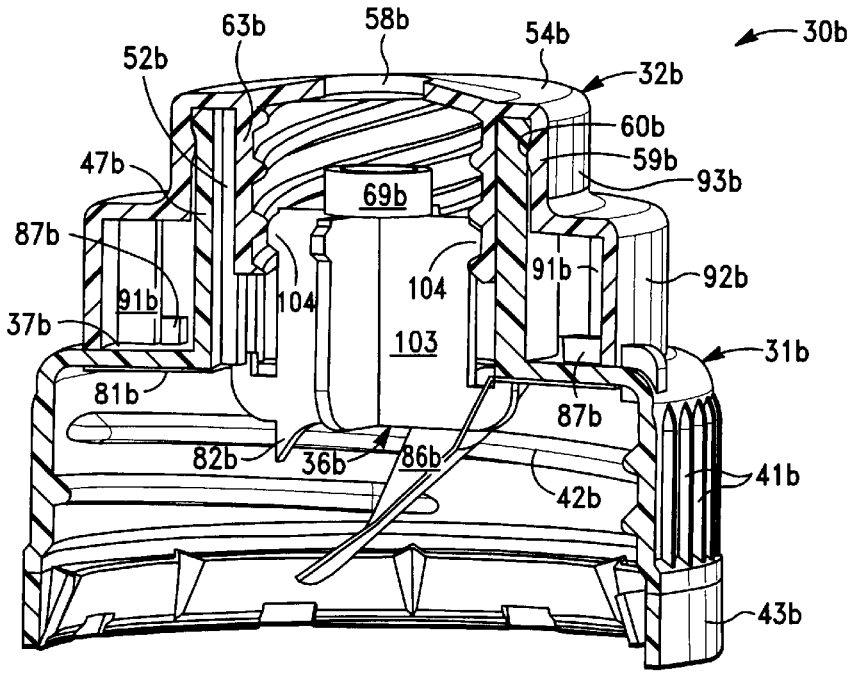
FIG. 11 is a perspective cross-sectional view of the closure of FIG. 10 showing the stem of the closure in an opened position.

FIGS. 10 and 11 show another embodiment in accordance with the present invention having a closure 30*b*. Like reference numerals have been used to describe like components of closures 30*b*, 30*a* and 30. Cap 31*b* and spout 32*b* are substantially the same as cap 31 and spout 32. Stem 36*b*, however, includes a cross-shaped structure having four substantially planar vanes 103 that are perpendicularly disposed with respect to one another. Advantageously, stem 36*b* provides a simple configuration that is easier to manufacture.

Stem 36*b* includes an outwardly extending spout-engaging member which is configured to allow helical motion between stem 36*b* and spout 32*b*. In particular, an external projection 104 extends outwardly from each vane 103 of stem 36*b* and cooperates with helical guides 64*b* of inner spout skirt 63*b*. One should appreciate that one, two, three or four vanes can be provided with a projection which cooperates with one or more helical grooves formed in the internal surface of the inner spout skirt.

A foil or membrane seal 81*b* is schematically shown in FIG. 10 and positioned immediately below top 37*b* of cap 31*b*. Stem 36*b* is provided with a downwardly extending piercing structure 82*b*. In the illustrated embodiment, piercing structure 82*b* is a downwardly extending portion of one or more of the tabs, for example, tab 75*b*, and includes a wedge portion. As stem 36*b* is axially slid from the initial closed position shown in FIG. 10 to the open position shown in FIG. 11, piercing structure 82*b* pierces into foil or membrane seal member 81*b* and cuts a flap 86*b* in member 81*b* in the same manner as piercing structure 82 discussed above.

Although the illustrated stem 36*b* includes four vanes, one should appreciate that the number of vanes can vary. For example, three, four or more vanes can be used in accordance with the present invention provided that one or more vanes includes structure to cooperate with the axial guide of the cap and one or more vanes includes structure to cooperate with the helical guides of the spout.

Figure 12:
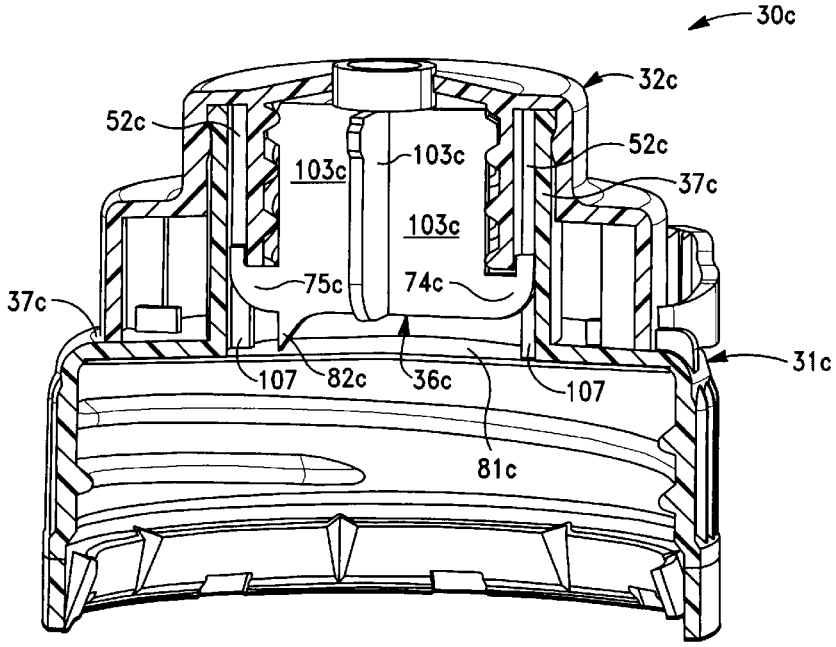
FIG. 12 is a perspective cross-sectional view of a modified closure for a membrane sealed container in accordance with the present invention similar to that shown in FIG. 1 with a modified cap.
Figure 13:
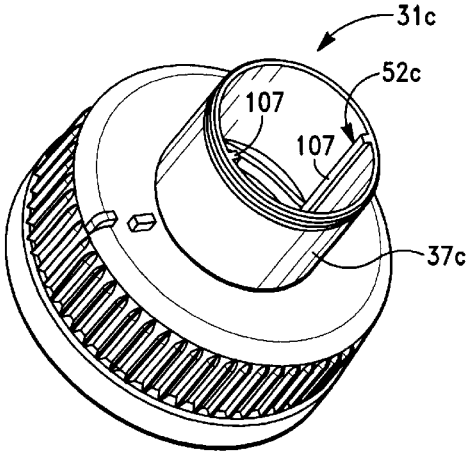
FIG. 13 is a perspective view of the cap of FIG. 12.
Figure 14:
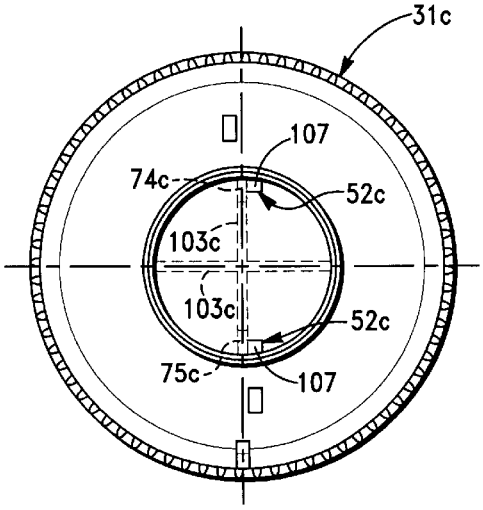
FIG. 14 is a top plane view of the cap of FIG. 12 showing a cross-sectioned portion of the stem of FIG. 12 in phantom.

FIGS. 12–14 show another embodiment in accordance with the present invention having a closure 30*c*. Like reference numerals have been used to describe like components of closures 30*c*, 30*b*, 30*a* and 30. Spout 32*c* and stem 36*c* are substantially the same as spout 32*b* and stem 36*b*.

Sleeve 37*c* of cap 31*c* includes a pair of offset stem guides 52*c*, each having a single vertically extending protrusion or spline 107. In contrast to the above embodiment shown in FIGS. 10 and 11 in which anti-rotation tabs 74*b* and 75*b* are received in stem groove 53*b* to prevent rotation of stem vanes 103 with respect to cap 31*b*, anti-rotation tabs 74*c* and 75*c*, which are dimensioned and configured to interfere with offset splines 107, prevent rotation of stem vanes 103*c* with respect to cap 31*c*, as can be seen in FIG. 14. Advantageously, cap 31*c* provides a simple configuration that is easier to manufacture.

A foil or membrane seal 81*c* is schematically shown in FIG. 12 and positioned immediately below top 37*c* of cap 31*c*. Stem 36*c* is provided with a downwardly extending piercing structure 82*c*. In the illustrated embodiment, piercing structure 82*c* is a downwardly extending portion of one or more of the tabs, for example, tab 75*c*, and includes a wedge portion. As stem 36*c* is axially slid from the initial closed position shown in FIG. 12 to an open position, piercing structure 82*c* pierces into foil or membrane seal member 81*c* and cuts a flap in member 81*c* in the same manner as piercing structure 82*b* discussed above.

In many respects the modifications of the various figures resemble those of preceding modifications and the same reference numerals followed by subscripts a and b designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A closure for a container having an opening, said closure comprising:

a cap including a cap top, a cap skirt depending from said cap top, a container-engaging member on said cap skirt, an open sleeve extending upwardly from said cap top, and a stem guide;

a spout rotatably engaging said sleeve, said spout including a spout top including a central aperture, an outer spout skirt depending from said spout top and rotatably engaging said sleeve, and an inner spout skirt depending from said spout top; and a stem including a plug for selectively sealing said central aperture, an outwardly extending spout-engaging member, and an outwardly extending cap-engaging member, said spout engaging member engaging said inner spout skirt for helical motion with respect to said inner spout skirt, said cap-engaging member engaging said stem guide for axial motion with respect to said sleeve.

2. The closure of claim 1 in which said container-engaging member comprises an inwardly extending thread adapted to detachably engage the container.

3. The closure of claim 2 in which said cap includes a tamper-evident band frangibly connected to a bottom portion of said cap skirt and adapted to detachably engage the container.

4. The closure of claim 1 in which said stem guide includes a substantially vertically extending groove and said cap-engaging member includes a tab received in said groove.

5. The closure of claim 1 in which a portion of said tab extends upwardly between said sleeve and said inner spout skirt.

6. The closure of claim 1 in which said cap further comprises a rotation stop limiting rotation of said spout relative to said cap.

7. The closure of claim 6 in which said rotation stop limits rotation of said spout relative to said cap up to approximately 360°.

8. The closure of claim 6 in which said rotation stop limits rotation of said spout relative to said cap to approximately 180°.

9. The closure of claim 1 in which said stem guide extends along an inner surface of said sleeve.

10. The closure of claim 1, said spout top further comprising a non-cylindrical outer wall forming a gripping portion facilitating gripping and rotation of said spout by a user.

11. The closure of claim 1 in which said outer wall is oval shaped.

12. The closure of claim 1 in which one of said cap and skirt include a tamper stop and the other of said cap and skirt includes a removable tamper tab engaging said tamper stop, said tamper tab engaging said tamper stop and preventing substantial rotation of said spout relative to said cap until said tamper tab is removed.

13. The closure of claim 1 in which the container opening is sealed by a sealing member, said stem further comprising a downwardly extending piercing structure adapted for piercing the sealing member of the container upon rotation of said spout relative to said cap.

14. The closure of claim 13 in which said stem guide includes a substantially vertically extending groove and said cap-engaging member includes a tab received in said groove, wherein said piercing member is a downwardly extending portion of said tab.

15. A closure for a container, said closure comprising:

a cap including a cap top, a cap skirt depending from said cap top and having an inwardly extending thread adapted to detachably engage the container, an open sleeve extending upwardly from said cap top, and a stem guide extending along an internal surface of said sleeve;

a spout rotatably engaging said sleeve, said spout including a spout top including a central aperture, an outer spout skirt depending from said spout top radially outward of said sleeve and rotatably engaging said sleeve, and an inner spout skirt depending from said spout top radially within said sleeve; and a stem including a body positioned radially within said inner spout skirt, a plug for selectively sealing said central aperture, an outwardly extending spout-engaging thread, and an outwardly extending cap-engaging member, said spout engaging member engaging said inner spout skirt and adapted for helical motion with respect to said inner spout skirt, said cap-engaging member engaging said stem guide and adapted for axial motion with respect to said sleeve.

16. The closure of claim 15 in which said body is substantially cylindrical.

17. The closure of claim 15 in which said cap includes a tamper-evident band frangibly connected to a bottom portion of said cap skirt.

18. The closure of claim 15 in which said cap further comprises a rotation stop limiting rotation of said spout relative to said cap.

19. The closure of claim 15 in which one of said cap and skirt include a tamper stop and the other of said cap and skirt includes a removable tamper tab engaging said tamper stop, said tamper tab engaging said tamper stop and preventing substantial rotation of said spout relative to said cap until said tamper tab is removed.

20. The closure of claim 15 in which the container opening is sealed by a foil member, said stem further comprising a downwardly extending foil piercing structure adapted for piercing the foil member of the container upon rotation of said spout relative to said cap.

21. The closure of claim 20 in which said stem guide includes a substantially vertically extending groove and said cap-engaging member includes a tab received in said groove, wherein said foil piercing structure is a downwardly extending portion of said tab.

* * * * *